United States Patent [19]

Ishibe

[11] 4,377,409

[45] Mar. 22, 1983

[54] STAINLESS STEEL SHORT FIBER AND PROCESS FOR PREPARING THE SAME

[75] Inventor: Hideomi Ishibe, Hirakata, Japan

[73] Assignee: Nippon Seisen Co., Ltd., Osaka, Japan

[21] Appl. No.: 277,208

[22] Filed: Jun. 25, 1981

[30] Foreign Application Priority Data

Jun. 27, 1980 [JP] Japan ..... 55-88035

[51] Int. Cl.[3] ..... B22F 1/00

[52] U.S. Cl. ..... 75/0.5 R; 75/0.5 AA; 75/0.5 BA; 148/126.1

[58] Field of Search ..... 75/0.5 R, 0.5 BA, 0.5 AA, 75/251; 428/606; 148/126

[56] References Cited

U.S. PATENT DOCUMENTS 3,425,813 2/1969 Orlemann ..... 75/251

4,166,736 9/1979 Bewley ..... 75/251

*Primary Examiner*—W. Stallard

*Attorney, Agent, or Firm*—Birch, Stewart, Kolasch & Birch

[57] ABSTRACT

A columnar stainless steel short fiber having a diameter of 2 to 20 μm. and an aspect ratio of the length to the diameter of 1 to 50. The short fiber is prepared by heat-treating a stainless steel fiber for adjusting the growth of crystal grains and subjecting the heat-treated fiber to intergranular selective corrosion in an acidic solution. The short fiber is useful as a material of sintered metallic filters, and sintered compacts of the short fiber have high porosity, uniform pore size, excellent mechanical strength and small pressure loss.

9 Claims, 16 Drawing Figures

FIG.1
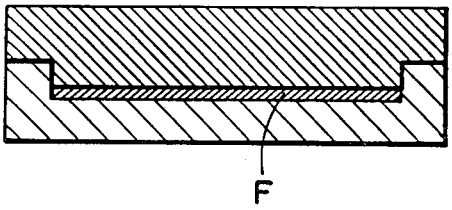
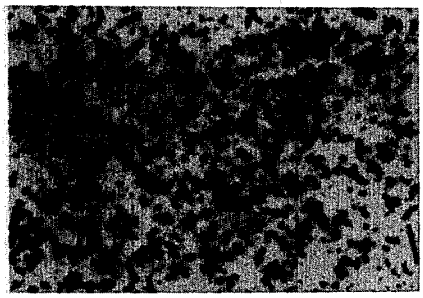
FIG. 2A
FIG. 2C
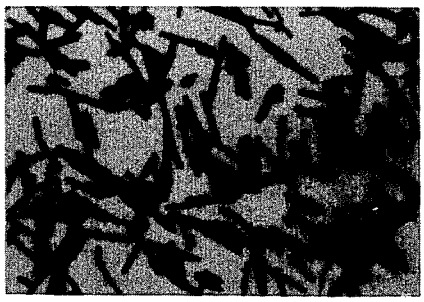
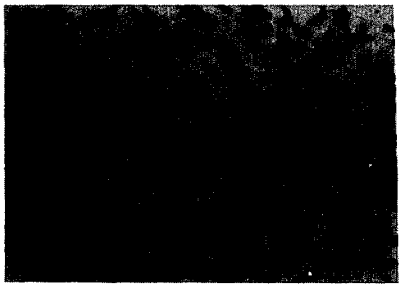
FIG. 2B

STAINLESS STEEL SHORT FIBER AND PROCESS FOR PREPARING THE SAME

BACKGROUND OF THE INVENTION

The present invention relates to a stainless steel short fiber which is particularly suitable for use as a material of a filter for separating fine particles in a fluid and a process for the preparation thereof.

Hitherto, membrane filters have been known as a filter medium and, for instance, used for separating fine particles having a particle size of less than 5 μm. These membrane filters have excellent characteristics such as being very thin, usually 50 μm, and uniform in pore size, but have the disadvantage that heat resistance, solvent resistance and mechanical strength are poor due to an organic material. On the other hand, known filter mediums made of a metallic material, include a sintered compact of a powder obtained by atomization, chemical extraction or precipitation, and a sintered body of a relatively long metal fiber or filament. The former has the disadvantage that, since the porosity is small due to the shape of the powder being nearly spherical and also due to the need to maintain the efficiency for trapping contaminants and the mechanical strength, a certain degree of thickness is required and, therefore, the pressure loss of a fluid passing becomes relatively large. Also, the latter has the disadvantage that the pore size distribution is wide. A sintered metallic filter free from these disadvantages has been desired. The present inventor has attempted to prepare such a sintered metallic filter by employing other metal powders, fibers and filaments, e.g. powders obtained by mechanical pulverization using a ball mill, jetmizer mill and the like, but these materials also could not provide a satisfactory filter.

It is an object of the present invention to provide a novel material useful particularly as a filter material.

A further object of the present invention is to provide a stainless steel short fiber useful particularly as a filter material capable of forming a metallic filter having a high porosity, a narrow pore size distribution and excellent mechanical characteristics.

A still further object of the present invention is to provide a stainless steel short fiber capable of forming a metallic filter having characteristics like a membrane filter in spite of a metallic material.

Another object of the present invention is to provide a process for preparing a stainless steel short fiber suitable particularly for use as a filter material.

These and other objects of the present invention will become apparent from the description hereinafter.

SUMMARY OF THE INVENTION

In accordance with the present invention, there is provided a stainless steel short fiber being in the form of a column and having a diameter in the range of 2 to 20 μm. and an aspect ratio of the length to the diameter in the range of 1 to 50, the diameter being substantially constant over the full length.

The stainless steel short fiber of the present invention is prepared by heat-treating a stainless steel long fiber or filament for adjusting the crystal grain growth and immersing the heat-treated fiber or filament in an acidic solution to conduct intergranular selective corrosion.

BRIEF DESCRIPTION OF THE DRAWINGS

FIG. 1 is a schematic section view showing an instance of a mold as used for sintering the stainless steel short fiber of the present invention;

FIGS. 2A, 2B, 2C, 3A, 3B, 3C and 3D are microphotographs showing the stainless steel short fibers of the invention;

DETAILED DESCRIPTION

Figure 3A:
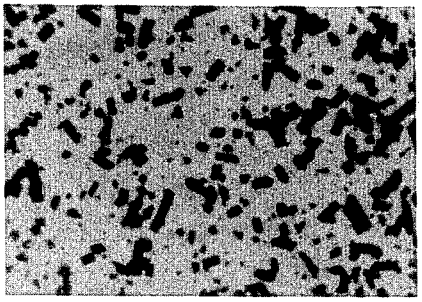
Figure 3B:
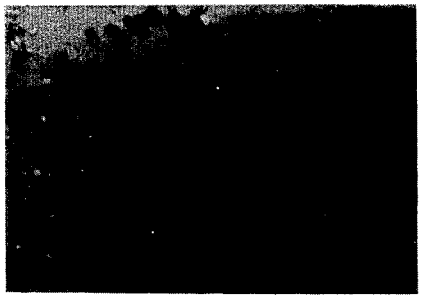
Figure 3C:
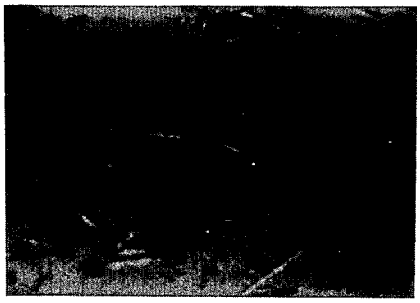
Figure 3D:
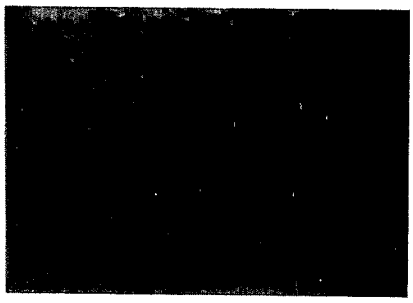

The stainless steel short fiber of the present invention has a columnar shape, and the diameter is substantially constant over the full length. The diameter of the short fiber falls within the range of 2 to 20 μm., and the aspect ratio of the length to the diameter falls within the range of 1 to 50. When the diameter of the short fiber is less than 2 μm., a sintered compact obtained therefrom has a wide pore size distribution and also is poor in mechanical strength. On the other hand, when the diameter is more than 20 μm., the porosity of the obtained sintered compact is decreased. Also, when the aspect ratio of the length to the diameter is less than 1, the porosity is small, and when the aspect ratio is more than 50, the pore size distribution is wide. The stainless steel short fiber of the present invention can provide a sintered compact having a high porosity, a uniform pore size and an excellent mechanical strength and, therefore, is very suitable as a material for providing a filter having both excellent characteristics of a membrane filter and a metallic filter.

The stainless steel short fiber of the invention is prepared by subjecting a stainless steel long fiber to a heat treatment for crystal grain growth adjustment and then subjecting the heat-treated fiber to intergranular selective corrosion in an aqueous acidic solution. The kind of the stainless steel is not particularly limited, and any stainless steels such as austenitic stainless steels, martensitic stainless steels and ferritic stainless steels can be employed as materials of the stainless steel long fibers. Austenitic stainless steels are preferred, and there is particularly preferred the so-called 18–8 type stainless steel of which the basic composition is a low content of carbon, 17 to 19% by weight of chromium and 8 to 10% by weight of nickel. Any known fibers of such stainless steels can be employed in the present invention as a starting material for preparing the short fiber of the invention. The length of the stainless steel long fiber to be treated is not particularly limited, but the fibers having a length of 2 to 20 cm., e.g. slivers, are convenient for the treating procedure. The use of a stainless steel long fiber having a diameter of less than 2 μm. is not suitable, since upon intergranular selective corrosion in an acidic solution in the next step, the acid does not act on the long fiber merely to corrode the grain boundaries, but further corrodes the crystal grains themselves. For this reason, when a stainless steel long fiber having a relatively small diameter, e.g. from 2 to 6 μm., is employed, it is desirable to pay attention to selection of the intergranular corrosion conditions such as the kind, concentration and temperature of the acidic solution and the immersion time so that only the grain boundaries are selectively corroded. On the other hand, when the diameter is more than 20 μm., it is difficult to shorten the stainless steel long fiber by the intergranular corrosion based on the process of the invention. A stainless steel long fiber having a diameter of 2 to 20 μm. is commercially available. In general, the higher the degree of elongation of a stainless steel fiber upon manufacture thereof, the longer the crystal unit and consequently the longer the short fiber produced tends to become.

The heat treatment for crystal grain growth adjustment of a stainless steel long fiber is carried out in a non-oxidative atmosphere at a temperature of 900° to 1,400° C. for a prescribed period of time. By the heat treatment within the above temperature range, the stress of the distortion of crystals elongated at the time of manufacturing the stainless steel fiber disappears, and soon crystal lattices arranged parallel in the longitudinal direction of the fiber are formed, while weak grain boundaries of lattices are decreased with the lapse of time. As a result, the distance between the grain boundaries widens, thus growing into crystal grains continuing in the longitudinal direction. The heat treatment is carried out usually for 10 minutes to 5 hours. Since the crystal grains grow with the lapse of the heat treating time, the stainless steel short fiber having a desired length can be obtained by controlling the temperature and time of the heat treatment. The stainless steel short fiber suitable as a filter material are those having an aspect ratio of 1 to 50, and in that case, preferably the heat treatment is carried out at a temperature of 1,000° to 1,200° C., especially in the vicinity of 1,100° C., for about 1 to 3 hours. In order to prevent lowering of physical properties by oxidation, the heat treatment is conducted in an atmosphere in which no oxygen is present, e.g. in an atmosphere of an inert gas such as argon gas, an exothermic converted gas, or an endothermic converted gas as produced by decomposing ammonia in the presence of a catalyst, e.g. nickel nitrate, at a temperature of 700° to 900° C.

The heat treatment for adjusting crystal grain growth in the present invention comprehends a solution treatment conducted at a temperature of 900° to 1,200° C. After the solution treatment, sensitization may be conducted at a temperature of 500° to 850° C., if desired. Such a two stage heat treatment is effective in some cases, for instance, in case of using as a starting material a stainless steel fiber having a relatively high carbon content of more than 0.08% such as SUS 301 stainless steel.

The heat treated stainless steel fiber is then subjected to selective corrosion of the grain boundaries by immersing in an acidic solution, whereby bonding between the crystal grains is broken to produce short fibers. The thus produced short fibers have no projections like fins, burrs or sags at either end. As an acidic solution, there is employed an aqueous solution of an inorganic acid such as, for instance, nitric acid, hydrochloric acid, hydrofluoric acid or sulfuric acid. The acid may be employed in combination with a metal salt of an acid, e.g. a combination of sulfuric acid and cupric sulfate or a combination of sulfuric acid and ferric sulfate. A combination of hydrofluoric acid and nitric acid is preferable as an acid. The kind and concentration of the acid is selected according to the kind of the stainless steel so that only the crystal grain boundary is selectively corroded. Also, the concentration of the acid , temperature of the solution and immersion time are suitably controlled according to the diameter of the stainless steel fiber used and the desired length of the short fiber to be produced. In case of hydrofluoric acid, the concentration is usually selected from 2 to 5% by weight. Also, nitric acid is usually employed in concentrations of at most 30% by weight, and other acids than the above are usually employed in concentrations of at most 40% by weight. The immersion is usually carried out at a temperature of 20° to 50° C. Martensitic stainless steels and ferritic stainless steels are poorer in corrosion resistance and thus have a higher sensitivity to intergranular corrosion than austenitic stainless steels. Therefore, in case of martensitic or ferritic stainless steels, the intergranular corrosion treatment is conducted under a weaker condition as compared with the case of austenitic stainless steels.

In order to avoid undesirable corrosion of metals, the acid solution may contain an inhibitor, e.g. an inorganic inhibitor such as a phosphate, a silicate or a chromate, and an organic inhibitor such as a high polymeric benzene derivative, quinoline, pyridine or polyethylene glycol.

After the intergranular corrosion treatment, the produced stainless steel short fiber is washed with water or a hot water and then dried. Preferably, after washing the produced short fiber with a hot water at about 80° C., passivation treatment is carried out to provide the short fiber with a corrosion resistance. The passivation treatment is carried out, for instance, by immersing the short fiber in a 30% nitric acid solution at about 40° C. for 1 to 3 hours. The passivation-treated fiber is washed with water at ordinary temperature and then dried.

The thus obtained short fiber is stable to corrosion, and moreover has substantially the same diameter as that of the starting stainless steel long fiber.

Figure 5:
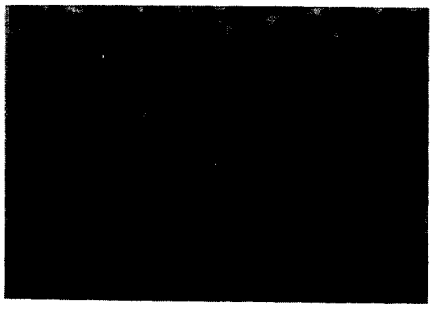
FIGS. 5 and 6 are microphotographs showing another sintered compacts made of the stainless steel short fiber of the invention.

By suitably selecting the kind of the stainless steel, the heat treating condition such as time and temperature and the intergranular corrosion condition such as kind and concentration of an acid and immersion time, it is also possible to prepare a stainless steel short fiber having a joined structure as shown in FIG. 5, in which the grain boundaries are corroded at some places to produce circumferential grooves, while they are still joined to each other. The depth of the groove, the space between the grooves and the length of the short fiber vary depending on the above conditions. When such a jointed short fiber is employed as a filter material, the obtained filter is easily traps contaminants to be filtered. Also, because of having an increased surface area, the jointed short fiber can be advantageously employed, for instance, as a catalyst.

The stainless steel short fiber of the present invention may be formed into a sintered compact in a known manner, for instance, into a sintered filter by employing a graphite mold as shown in FIG. 1 wherein numeral F is the stainless steel short fiber. The sintering is usually carried out in an atmosphere of an inert gas such as argon gas at a temperature of 1,000° to 1,300° C. for 30 minutes to 2 hours under pressure. By the sintering, the short fibers are diffusedly bonded to each other at points of contact, thus giving a firm sintered compact.

The thus obtained sintered compact has a high porosity and a narrow pore size distribution, namely a uniform pore size, and accordingly when used as a filter medium, it exhibits excellent effects such that the pressure loss is small and also contaminants larger than a specific particle size can be effectively collected.

Although the sintered compact is employed alone as a filter medium, it is also employed in combination with other filter mediums, e.g. in the form of a laminate with a metal fiber or filament felt, a net or a wire mesh, or in a sandwich structure in which the sintered compact is laminated on both sides with a metal fiber or filament felt and a wire mesh. In that case, there is obtained a filter medium having excellent characteristics, e.g. mechanical strength, of a laminating material as well as the characteristics of the sintered compact. It is also possible to admix the stainless steel short fiber of the present invention with other materials and to form the mixture into a sintered filter.

The present invention is more specifically described and explained by means of the following Examples, in which all % are by weight unless otherwise noted.

The SUS Numbers as shown herein are numbers defined in Japanese Industrial Standards (JIS) and showing the kinds of stainless steels.

EXAMPLE 1

A fiber having a diameter of 8 μm. and a length of about 3 cm. of SUS 304 stainless steel was heat-treated in an inert gas atmosphere at 1,100° C. for 1 hour. The heat-treated stainless steel fiber was then subjected to intergranular selective corrosion by immersing in a mixture of 4% hydrofluoric acid and 20% nitric acid (1:1 by volume) at 40° C. for 10 minutes. The produced short fiber was washed with a hot water. The short fiber was then treated for passivation with 30% nitric acid, and washed with water and dried.

The diameter of the produced stainless steel short fiber was about 8 μm., and the average length was about 50 μm.

EXAMPLE 2

By employing a SUS 304 stainless steel fiber having a diameter of 12 μm. and a length of 20 cm., a stainless steel short fiber was prepared in the same manner as in Example 1 except that the heat treatment was conducted for 1, 2 or 3 hours.

The shapes of the produced short fibers were observed by a microscope of 50 magnifications. The microphotographs are shown in FIGS. 2A, 2B and 2C, respectively. As is clear from these figures, the produced short fiber becomes longer with increase in the heat treating time, since the crystal grains grow with the lapse of heat treating time.

The short fibers have approximately the same diameter as that of the starting fiber. The aspect ratio of the length to the diameter of the obtained short fibers are shown in Table 1.

TABLE 1

| Treating time | 1 hour | 2 hours | 3 hours |
|---|---|---|---|
| Aspect ratio | 1 to 5 | 2 to 13 | 4 to 19 |
| Average | 3 | 8 | 14 |

EXAMPLE 3

By employing SUS 304 stainless steel fibers having diameters of 12, 8, 6 and 4 μm., stainless steel short fibers were prepared in the same manner as in Example 1.

The shapes of the produced short fibers were observed by a microscope of 80 magnifications. The microphotographs of the short fibers prepared from the starting fibers of 12, 8, 6 and 4 μm. in diameter are shown in FIGS. 3A, 3B, 3C and 3D, respectively. From the figures, it is seen that the smaller the diameter of the starting fiber, the longer the length of the produced short fiber. This results from the fact that the smaller the diameter of a stainless steel fiber the longer is, the degree of elongation at the time of manufacturing the fiber, and as a result, the longer is the crystal unit.

The diameters of the short fibers were approximately the same as those of the starting fibers. The aspect ratios of the length to the diameter of the produced short fibers are shown in Table 2.

TABLE 2

| Fiber diameter | 12 μm. | 8 μm. | 6 μm. | 4 μm. |
|---|---|---|---|---|
| Aspect ratio | 1 to 5 | 2 to 13 | 2 to 17 | 2 to 20 |
| Average | 3 | 7 | 10 | 9.5 |

EXAMPLE 4 and Comparative Example 1

A SUS 304 stainless steel fiber having a diameter of 12 μm. was heat-treated in an inert gas atmosphere at 1.100° C. for 3 hours, and was then immersed in the same aqueous acid solution as used in EXAMPLE 1 at 40° C. for 10 minutes to give a stainless steel short fiber. The short fiber was placed in a graphite mold shown in FIG. 1 and sintered under the following conditions into a sintered compact of disk shape having a diameter of 59 mm. and a thickness of about 1 mm.

Sintering temperature: 1,100° C.
Sintering time: 1 hour
Atmosphere: Inert atmosphere of argon gas
Pressure at sintering: 10 kg./cm$^2$.

Figure 4A:
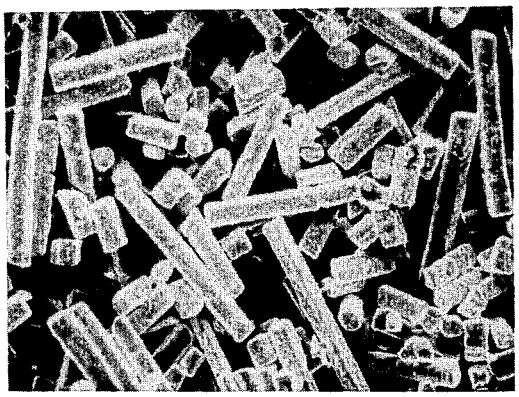
FIGS. 4A and 4B are photographs enlarged 400 times by a scanning type electron microscope showing a sintered compact made of the stainless steel short fiber of the invention and a sintered compact made of a conventional atomized powder, respectively.

A microphotograph of the surface of the thus obtained sintered compact enlarged 400 times by a scanning electron microscope is shown in FIG. 4A.

Also, as Comparative Example 1, a sintered compact was prepared in the same manner as above by employing a conventional atomixed powder (under 400 meshes) of a stainless steel (chromium content: 13%). A microphotograph of the surface of the sintered compact of the atomized powder enlarged 400 times is shown in FIG. 4B.

Figure 4B:
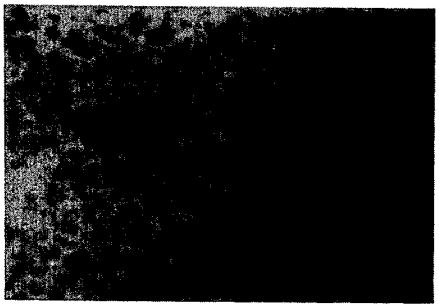

From FIGS. 4A and 4B, it is seen that the sintered compact made of the short fiber of the present invention has a larger porosity and a more uniform pore size as compared with the sintered compact made of the atomized powder, and also that the respective short fibers have end portions finely broken at nearly a right angle without causing projections and are in the form of column having a constant diameter over the full length.

EXAMPLE 5

A stainless steel short fiber was prepared in the same manner as in Example 1 except that SUS 316L stainless steel fiber having a diameter of 8 μm. was employed instead of SUS 304 stainless steel fiber. The obtained short fiber was then sintered in the same manner as in Example 4, and the sintered compact was observed by a scanning electron microscope of 300 magnifications.

The microphotograph of the sintered compact is shown in FIG. 5. As is understood from FIG. 5, the crystal grain boundaries are cleaved at some places by corrosion to produce short fibers, and another places the crystal grain boundaries are corroded to produce circumferential grooves in the state that they are still joined to each other without being cleaved. Thus, the respective short fibers produced have a jointed structure.

EXAMPLE 6

A stainless steel short fiber was prepared in the same manner as in Example 1 except that the diameter of the employed SUS 304 stainless steel fiber was 12 μm. Sintering was carried out at a temperature just below the melting point of the stainless steel according to the manner as in Example 4.

Figure 6:
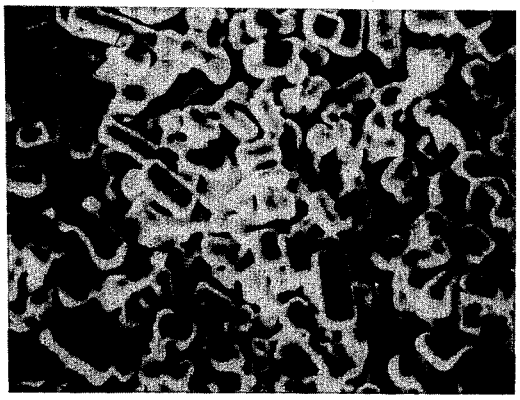

The microphotograph of the sintered compact is shown in FIG. 6, from which it is seen that the diffused bonding of the short fibers further proceeds and the short fibers melt-join to form a firm sintered compact.

EXAMPLE 7

By employing the stainless steel short fibers having different diameters obtained in Example 3, sintered compacts were prepared under the same sintered condition as in Example 4.

The porosity of each sintered compact was measured. The term "porosity" as used herein means the percentage of the pore volume in a sintered compact.

The results are shown in Table 3.

TABLE 3

| Fiber diameter (μm.) | 12 | 8 | 6 | 4 |
|---|---|---|---|---|
| Porosity (%) | 65 | 70 | 74 | 78 |

From Table 3, it is understood that sintered compacts prepared from the short fibers of the present invention have a high porosity, since the porosity of a sintered compact prepared from a usual metal powder is about 50%. It is also understood that the smaller the diameter of the short fiber, the higher the porosity.

EXAMPLES 8 and 9 and Comparative Example 2

By employing SUS 304 and SUS 316L stainless steel short fibers (Examples 8 and 9) prepared according to the procedure of Example 1 and an atomized SUS 410 stainless steel powder (Comparative Example 2), sintered compacts of disk shape were prepared under the following sintering conditions.

Sintering temperature: 1,100° C.

Sintering time: 1 hour

Atmosphere: Inert atmosphere of argon gas

Pressure at sintering: 100 kg./cm$^2$.

The properties of the sintered compacts are shown in Table 4.

TABLE 4

| | Example 8 | Example 9 | Com. Ex. 2 |
|---|---|---|---|
| Kind of stainless steel | SUS 304 | SUS 316L | SUS 410 |
| Short fiber | | | |
| Fiber diameter (μm.) | 12 | 8 | — |
| Average aspect ratio | 3 | 7 | — |
| Particle size (mesh) | — | — | under 400 |
| Sintered compact | | | |
| Shape: Disk | | | |
| Diameter (mm.) | 59 | 59 | 59 |
| Thickness (mm.) | 1.11 | 1.44 | 1.28 |
| Porosity (%) | 50.8 | 53.4 | 43.9 |
| $P_1/P_0$ (at 45% in porosity) | 1.26 | 1.29 | 1.39 |

It is clear from Table 4 that the sintered compacts prepared from the stainless steel short fibers of the present invention have a higher porosity than that of the sintered compact prepared from the stomized powder.

Figure 7:
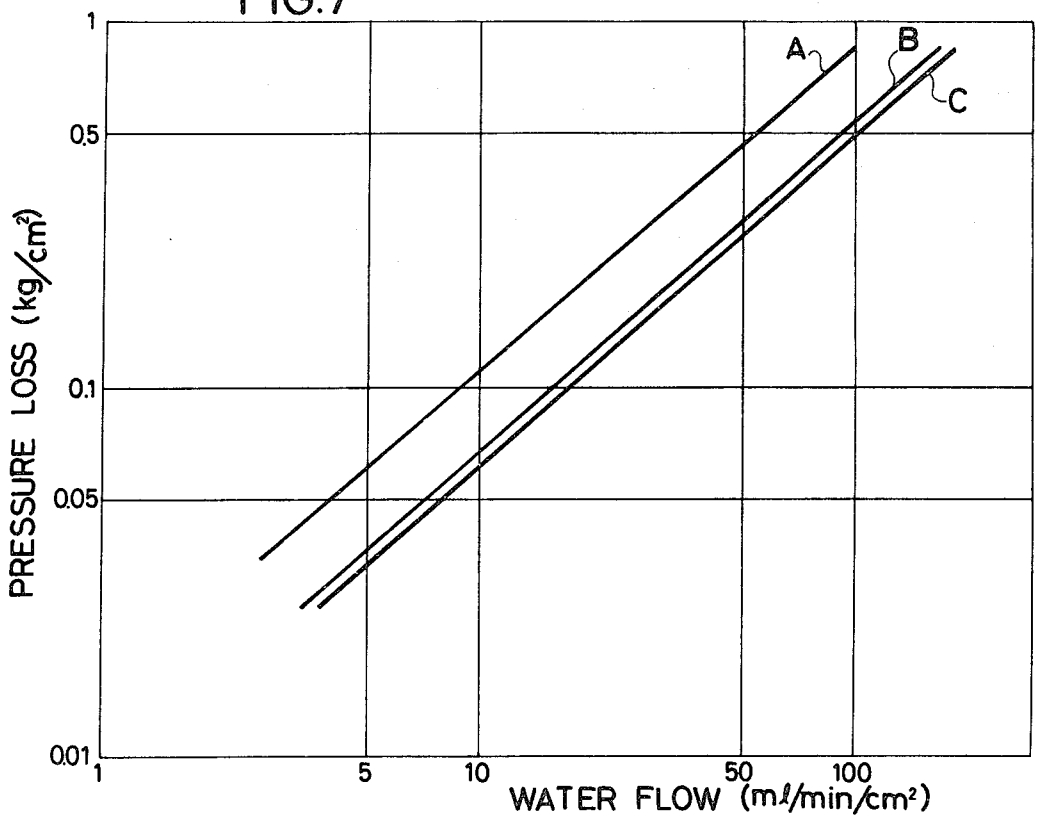
FIG. 7 is a graph showing the relationship between the pressure loss and the flow rate of a fluid.

The pressure loss when passing water through these sintered compacts was measured. The results are shown in FIG. 7, in which straight lines A, B and C are for Comparative Example 2, Example 8 and Example 9, respectively. In case of the sintered compacts of the short fibers of the present invention, the pressure loss is about 50 to 60% of the pressure loss of Comparative Example 2, and is very low.

Figure 8:
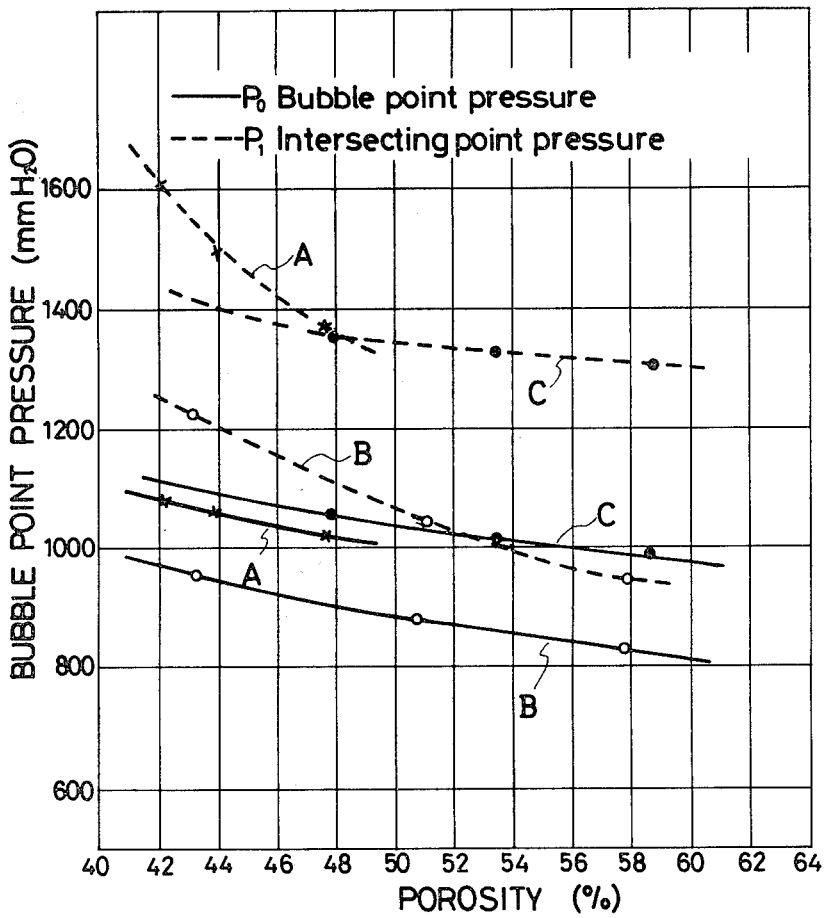
FIG. 8 is a graph showing the relationship between the porosity and the bubble point pressure.

Further, sintered compacts having different porosities were prepared in the same manner as above except that the sintering pressure was changed. A bubble point pressure $P_o$ and an intersecting point pressure $P_1$ were measured according to the filtration size testing method in JIS B 8356. The relationship between the porosity and the bubble point pressure $P_o$ and intersecting point pressure $P_1$ is shown in FIG. 8, in which curve A is for the sintered compacts of the atomized powder, curve B is for the sintered compacts of the short fiber 12 μm. in diameter and curve C is for the sintered compacts of the short fibers 8 μm. in diameter. There is also shown in Table 4 the ratio of the intersecting point pressure $P_1$ to the bubble point pressure $P_o$ at 45% in porosity.

The term "bubble point pressure" as used herein means the pressure when a bubble generates first in the above filtration size test of JIS B 8356. Also, the term "intersecting point pressure" as used herein means the pressure at the intersecting point of the lines extrapolated from the large variation portion and the small variation portion of a curve of variation of the air pressure against the amount of flowing air in the above filtration size test.

As seen in FIG. 8, the sintered compact of the short fiber having a diameter of 8 μm. (Ex. 9) shows a high bubble point pressure in spite of having the largest porosity (53.4%). The bubble point pressure is a measure for the maximum pore in a sintered compact, and this fact means that the pore size distribution of the sintered compact is narrow, in other words, the pore size is uniform and shows that the sintered compact according to the invention is particularly suitable as a filter medium. This can also be understood from the $P_1/P_o$ value shown in Table 4. That is to say, the $P_1/P_o$ value is a measure for the pore size distribution, and the nearer the value $P_1/P_o$ comes to 1, the narrower the pore size distribution. For instance, in case that the porosity is 45%, the $P_1/P_o$ values 1.26 and 1.29 of the sintered compacts of the short fibers having diameters of 12 μm. and 8 μm. are smaller than the $P_1/P_o$ value 1.39 of the sintered compact of atomized powder, and it is understood that the sintered compacts of the short fiber of the invention has a narrower pore size distribution. Also, as is clear from FIG. 8, the $P_1/P_o$ value varies with the porosity, and for instance, in case of the sintered compact of the short fiber 12 μm. in diameter, when the porosity is 58%, the $P_1/P_o$ value is about 1.2 and the pore size distribution becomes further narrow.

With respect to a sintered compact of the short fiber 12 μm. in diameter which has 45% porosity and a sintered compact of the atomized powder which has the same porosity, their pressure losses were measured by passing water through them. The results are shown in FIG. 9, in which the curve A is for the sintered compact of atomized powder and the curve B is for the sintered compact of short fiber.

Also, with respect to a sintered compact of the short fiber 8 μm. in diameter which has 360 $mmH_2O$ bubble point pressure and a sintered compact of the atomized powder which has the same bubble point pressure, the pressure losses were measured. The results are shown in FIG. 10, in which the curve A is for the sintered compact of atomized powder and the curve C is for the sintered compact of short fiber.

Figure 9:
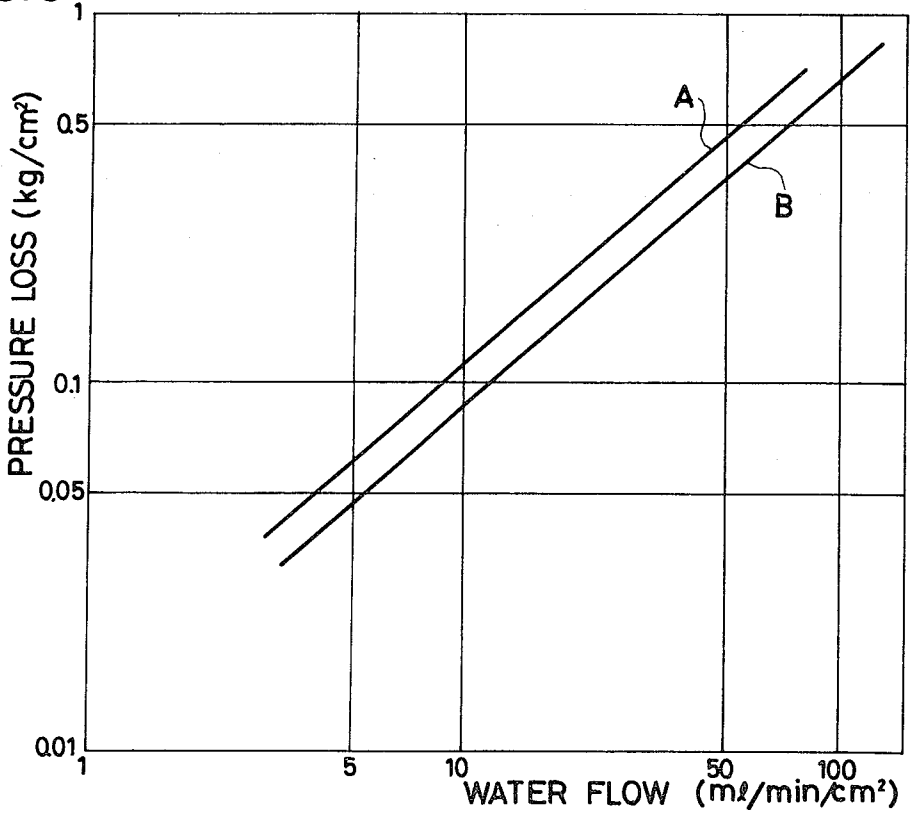
FIGS. 9 and 10 are graphs showing the relationship between the pressure loss and the flow rate of a fluid.
Figure 10:
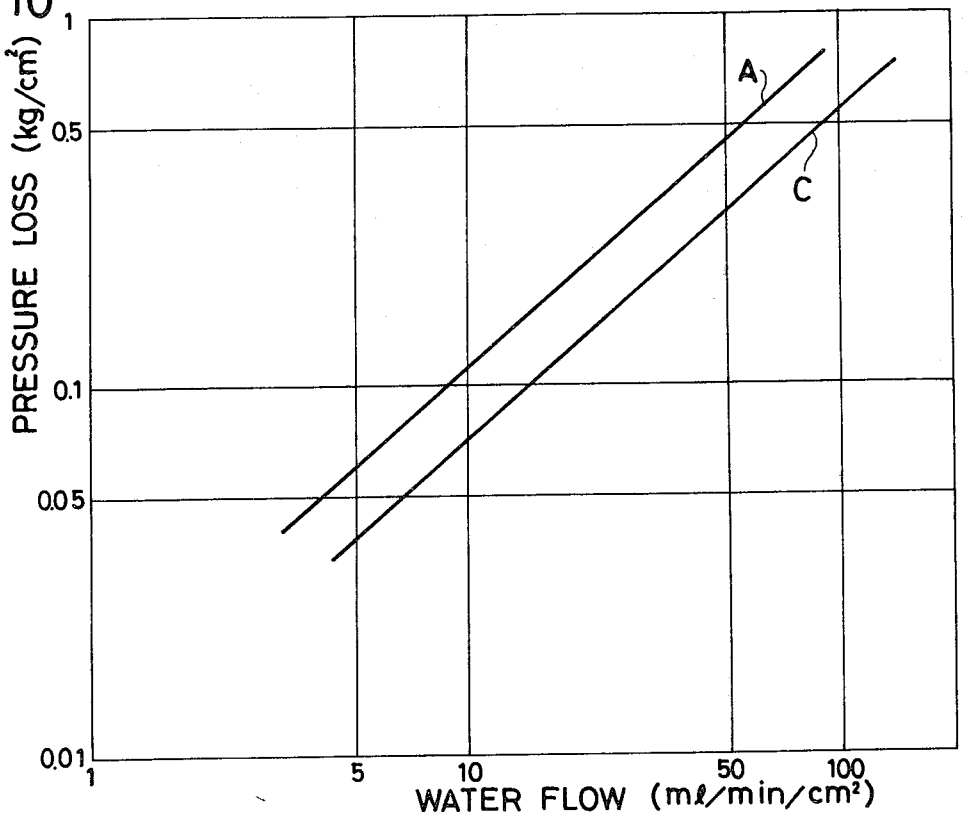

These graphs on FIGS. 9 and 10 show that the pressure loss of sintered compacts made of the stainless steel short fibers of the present invention is lower than that of sintered compacts made of a conventional stainless steel atomized powder.

What is claimed is:

1. A stainless steel short fiber being in the form of column and having a diameter in the range of 2 to 20 μm. and an aspect ratio of the length to the diameter in the range of 1 to 50, the diameter being substantially constant over the full length.

2. A process for preparing a stainless steel short fiber which comprises subjecting a stainless steel fiber having a diameter of 2 to 20 μm. to heat treatment for adjusting crystal grain growth, and subjecting the heat treated fiber to intergranular selective corrosion in an aqueous acidic solution.

3. The process of claim 2, wherein said heat treatment is carried out in a non-oxidative atmosphere at a temperature of 900° to 1,400° C. for 10 minutes to 5 hours.

4. The process of claim 2, wherein said aqueous acidic solution is an aqueous solution of an inorganic acid.

5. The process of claim 2, wherein said aqueous acidic solution is an aqueous solution of hydrofluoric acid and nitric acid.

6. The process of claim 2, wherein after said intergranular selective corrosion, the fiber is subjected to sensitization at a temperature of from about 500° C. to about 850°C.

7. The process of claim 2, wherein said aqueous acidic solution contains a corrosion inhibitor.

8. The process of claim 2, wherein said inhibitor is an inorganic inhibitor selected from the group consisting of a phosphate, a silicate and a chromate, or an organic inhibitor selected from the group consisting of a high polymeric benzene derivative, quinoline, pyridine and polyethylene glycol.

9. The process of claim 2, wherein after said intergranular selective corrosion, the fiber is subject to passivation treatment comprising immersing the fiber in a 30% nitric acid solution at about 40° C. for about 1 to 3 hours.

* * * * *